US009196963B2

(12) United States Patent
Rhyu et al.

(10) Patent No.: US 9,196,963 B2
(45) Date of Patent: Nov. 24, 2015

(54) MOBILE TERMINAL

(75) Inventors: Hanphil Rhyu, Seoul (KR); Sungjoon Hong, Gyeonggi-Do (KR); Sungjung Rho, Seoul (KR); Jaegon Lee, Gyeonggi-Do (KR)

(73) Assignee: LG ELECTRONICS INC., Seoul (KR)

( * ) Notice: Subject to any disclaimer, the term of this patent is extended or adjusted under 35 U.S.C. 154(b) by 118 days.

(21) Appl. No.: 13/469,871

(22) Filed: May 11, 2012

(65) Prior Publication Data

US 2012/0327621 A1 Dec. 27, 2012

(30) Foreign Application Priority Data

Jun. 23, 2011 (KR) ..... 10-2011-0061340

(51) Int. Cl.
*H01Q 7/00* (2006.01)
*H01Q 1/24* (2006.01)

(52) U.S. Cl.
CPC . *H01Q 7/00* (2013.01); *H01Q 1/243* (2013.01)

(58) Field of Classification Search
CPC ..... H01Q 1/38; H01Q 1/243; H01Q 5/0058
USPC ..... 343/846, 866–871; 361/814
See application file for complete search history.

(56) References Cited

U.S. PATENT DOCUMENTS 6,229,993 B1 * 5/2001 Greenaway et al. ..... 455/575.1
6,624,789 B1 * 9/2003 Kangasvieri et al. ..... 343/702
6,980,154 B2 * 12/2005 Vance et al. ..... 343/700 MS
7,079,079 B2 * 7/2006 Jo et al. ..... 343/700 MS
7,236,134 B2 * 6/2007 Licul et al. ..... 343/702
7,358,906 B2 * 4/2008 Sato et al. ..... 343/702
7,800,550 B2 * 9/2010 Hsieh et al. ..... 343/795
2007/0257851 A1 * 11/2007 Balzovsky et al. ..... 343/726
2008/0018543 A1 * 1/2008 Baliarda et al. ..... 343/702
2010/0085268 A1 4/2010 Yeh et al.
2011/0003623 A1 * 1/2011 Na et al. ..... 455/575.1
2011/0215978 A1 9/2011 Lindenmeier et al.

FOREIGN PATENT DOCUMENTS

EP 1555715 A1 7/2005
EP 2040329 A2 3/2009
EP 2296227 A2 3/2011
KR 10-2008-0112502 A 12/2008
KR 10-2009-0014133 A 2/2009
KR 10-2009-0080712 A 7/2009

* cited by examiner

*Primary Examiner* — Zachary M. Pape
*Assistant Examiner* — Douglas Burtner
(74) *Attorney, Agent, or Firm* — Birch, Stewart, Kolasch & Birch, LLP

(57) ABSTRACT

A mobile terminal including a terminal body having a ground; a first conductive member and a second conductive member mounted in the terminal body, and spaced from each other and configured to transmit and receive a radio signal; a feed connection portion connected to the first conductive member and configured to feed-connect the first conductive member to the ground; and a first ground connection portion connected to the second conductive member and configured to ground-connect the second conductive member to the ground. Further, the first conductive member and the second conductive member are connected to each other so as to form a loop.

6 Claims, 9 Drawing Sheets

MOBILE TERMINAL

CROSS-REFERENCE TO RELATED APPLICATIONS

Pursuant to 35 U.S.C. §119(a), this application claims the benefit of earlier filing date and right of priority to Korean Application No. 10-2011-0061340, filed on Jun. 23, 2011, the contents of which is incorporated by reference herein in its entirety.

BACKGROUND OF THE INVENTION

1. Field of the Invention

The present invention relates to a mobile terminal, and more particularly, to a mobile terminal having an antenna portion for transmitting and receiving a radio signal.

2. Background of the Invention

In general, a terminal may be classified into a mobile (portable) terminal and a stationary terminal according to a moveable state. The mobile terminal may be also classified into a handheld terminal and a vehicle mount terminal.

The terminal support many complicated functions such as capturing images or video, reproducing music or video files, playing games, receiving broadcast signals, and the like. Thus, the mobile terminal now functions as a multimedia player or a device.

Various attempts have been made to implement complicated functions in such a multimedia device using hardware or software. For instance, the mobile terminal includes a User Interface (UI) environment allowing a user to easily and conveniently search for or select a desired function. The mobile terminal has also become a necessity for many users and thus the efficient design and appearance of the mobile terminal is desired by the user.

SUMMARY OF THE INVENTION

Accordingly, one object of the present invention is to address the above-noted and other problems with the related art.

Another object is to provide a mobile terminal having an antenna device with an enhanced function that can transmit and receive a multi radio signal of a high frequency and a low frequency.

To achieve these and other advantages and in accordance with the purpose of this specification, as embodied and broadly described herein, the present invention provides a mobile terminal including a terminal body having a ground; a first conductive member and a second conductive member mounted in the terminal body, and spaced from each other and configured to transmit and receive a radio signal; a feed connection portion connected to the first conductive member and configured to feed-connect the first conductive member to the ground; and a first ground connection portion connected to the second conductive member and configured to ground-connect the second conductive member to the ground. Further, the first conductive member and the second conductive member are connected to each other so as to form a loop.

In another aspect, the present invention provides a mobile terminal including a terminal body having a ground; first and second conductive members mounted in the terminal body, spaced from each other in a predetermined interval and disposed in parallel so as to form at least one slot, and connected to each other so as to form a loop; a feed connection portion connected to the first conductive member and configured to feed-connect the ground to the first conductive member; and one or more ground connection portions configured to ground-connect the ground to the second conductive member so that paths formed from the feed-connection portion via the respective first and second conductive members have different resonant lengths for transmitting and receiving radio signals at different frequency bands.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

The mobile terminal according to an embodiment of the present invention includes a portable phone, a smart phone, a laptop computer, a digital broadcasting terminal, Personal Digital Assistants (PDA), Portable Multimedia Player (PMP), a navigation system, etc., and a fixed terminal such as a digital TV, a desktop computer, etc.

Figure 1:
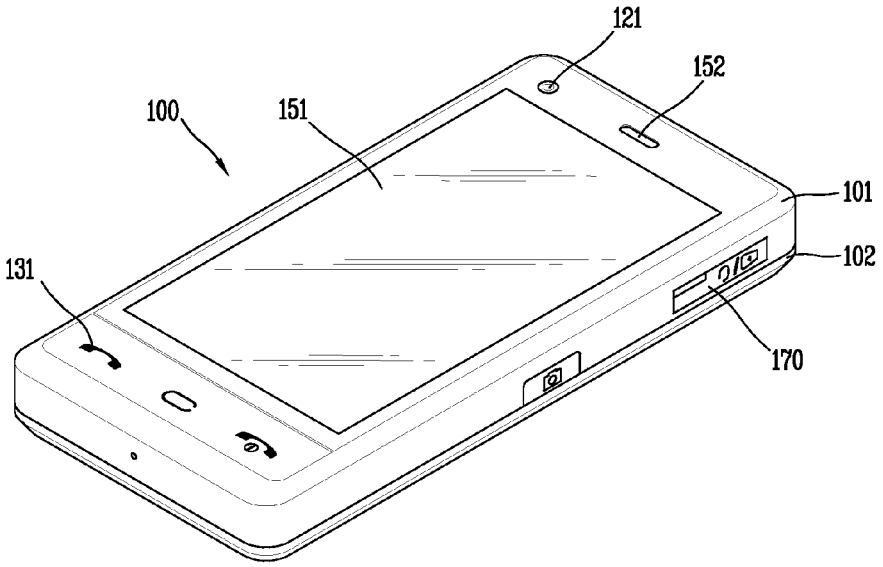
FIG. 1 is a front perspective view of a mobile terminal according to one embodiment of the present invention.

FIG. 1 is a block diagram of a mobile terminal 100 according to one embodiment of the present invention. The mobile terminal 100 may be a bar-type mobile terminal including one body. However, the present invention is not limited to this. That is, the present invention is also applicable to various structures such as a slide type where at least two bodies are coupled to each other so as to perform a relative motion, a folder type, a swing type, a swivel type, etc.

As shown in FIG. 1, a case (casing, housing, cover, etc.) forming an outer appearance of a body includes a front case 101 and a rear case 102. A space formed by the front case 101 and the rear case 102 accommodates various components therein. At least one intermediate case may further be disposed between the front case 101 and the rear case 102. Such cases may be formed by injection-molded synthetic resin, or may be formed using a metallic material such as stainless steel (STS) or titanium (Ti).

In addition, the front case 101 includes a display unit 151, an audio output unit 152, a camera 121, user input units 131 and 132, a microphone 122, an interface unit 170, etc. As shown, in this embodiment, the display unit 151 occupies most a main surface of the front case 101. Further, the audio output unit 152 and the camera 121 are arranged at a region adjacent to one end of the display unit 151, and the user input unit 131 and the microphone 122 are arranged at a region adjacent to another end of the display unit 151. The user input unit 132, the interface unit 170, etc. may be arranged on side surfaces of the front case 101 and the rear case 102.

In addition, the display unit 151 displays information processed in the mobile terminal 100. For example, when the mobile terminal 100 is in a phone call mode, the display unit 151 may display a User Interface (UI) or a Graphic User Interface (GUI) associated with a call or other communication (such as text messaging, multimedia file downloading, etc.). When the mobile terminal 100 is in a video call mode or image capturing mode, the display unit 151 may display a captured image and/or received image, a UI or GUI that shows videos or images and functions related thereto, and the like.

The display unit 151 may include at least one of a Liquid Crystal Display (LCD), a Thin Film Transistor-LCD (TFT-LCD), an Organic Light Emitting Diode (OLED) display, a flexible display, a three-dimensional (3D) display, or the like. Some of these displays may be configured to be transparent so that outside may be seen therethrough, which may be referred to as a transparent display. A representative example of the transparent display may include a Transparent Organic Light Emitting Diode (TOLED), and the like. The rear surface portion of the display unit 151 may also be implemented to be optically transparent. Under this configuration, a user can view an object positioned at a rear side of a body through a region occupied by the display unit 151 of the body.

Further, the display unit 151 may be implemented in two or more in number according to a configured aspect of the mobile terminal 100. For instance, a plurality of displays may be arranged on one surface integrally or separately, or may be arranged on different surfaces.

Also, if the display unit 151 and a touch sensitive sensor (referred to as a touch sensor) have a layered structure therebetween, the structure can be referred to as a touch screen. The display unit 151 may also be used as an input device rather than an output device, and the touch sensor may be implemented as a touch film, a touch sheet, a touch pad, and the like.

Further, the interface unit 170 is generally implemented to interface the mobile terminal 100 with external devices. The interface unit 170 may allow a data reception from an external device, a power delivery to each component in the mobile terminal 100, or a data transmission from the mobile terminal 100 to an external device. The interface unit 170 may include, for example, wired/wireless headset ports, external charger ports, wired/wireless data ports, memory card ports, ports for coupling devices having an identification module, audio Input/Output (I/O) ports, video I/O ports, earphone ports, and the like.

The touch sensor may be configured to convert changes of a pressure applied to a specific part of the display unit 151, or a capacitance occurring from a specific part of the display unit 151, into electric input signals. Also, the touch sensor may be configured to sense not only a touched position and a touched area, but also a touch pressure.

When touch inputs are sensed by the touch sensors, corresponding signals are transmitted to a touch controller. The touch controller processes the received signals, and then transmits corresponding data to the controller 180. Accordingly, the controller 180 can sense which region of the display unit 151 has been touched.

In addition, the user input unit is manipulated to receive a command for controlling the operation of the mobile terminal 100, and in FIG. 1 includes a plurality of manipulation units 131 and 132. The manipulation units 131 and 132 may be referred to as manipulating portions, and may include any type of ones that can be manipulated in a user's tactile manner. Also, commands input through the first or second user input units 131 and 132 may be variously set. For instance, the first manipulation unit 131 is configured to input commands such as START, END, SCROLL or the like, and the second manipulation unit 132 is configured to input commands for controlling a level of sound output from the audio output unit 152, or commands for converting the current mode of the display unit 151 to a touch recognition mode.

Figure 2:
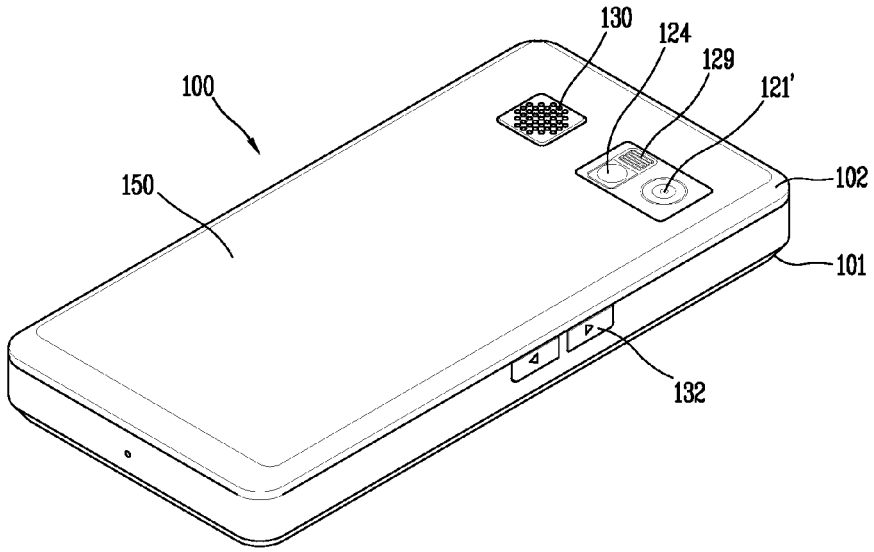
FIG. 2 is a rear perspective view of the mobile terminal of FIG. 1.

Next, FIG. 2 is a rear perspective view of the mobile terminal 100 of FIG. 1. Referring to FIG. 2, a camera 121' is additionally provided on the rear case 102. The camera 121' faces a direction which is opposite to a direction faced by the camera 121, and may have different pixels from those of the camera 121.

In addition, the camera 121 may operate with relatively lower pixels (lower resolution). Thus, the camera 121 may be useful when a user can capture his face and send it to another party during a video call or the like. On the other hand, the camera 121' may operate with a relatively higher pixels (higher resolution) such that it can be useful for a user to obtain higher quality pictures for later use. The cameras 121 and 121' may be installed at a terminal body so as to rotate or pop-up.

A flash 123 and a mirror 124 are additionally disposed adjacent to the camera 121'. The flash 123 operates in conjunction with the camera 121' when taking a picture using the camera 121', and the mirror 124 can cooperate with the camera 121' to allow a user to photograph himself or herself in a self-portrait mode.

An audio output unit 130 may be additionally arranged on a rear surface of the terminal body and cooperate with the audio output unit 152 disposed on a front surface of the terminal body so as to implement a stereo function. Also, the audio output unit 130 may be configured to operate as a speakerphone.

A broadcast signal receiving antenna as well as an antenna for calling may also be disposed on a side surface of the terminal body. The broadcast signal receiving antenna which constitutes a part of a broadcasting receiving module may be configured to retract into the terminal body.

In addition, a power supply unit 150 for supplying power to the mobile terminal 100 is mounted to the terminal body. The power supply unit may be mounted in the terminal body, or may be configured to be detachable from the outside of the terminal body. The power supply unit 150 may be mounted to the mobile terminal 100 by a battery cover 190 (see FIG. 3).

A touch pad for detecting touch may be additionally mounted to the rear case 102. The touch pad may be also configured to be transmissive like the display unit 151. When the display unit 151 is configured to output visual information from two surfaces, the visual information may be recognized even through the touch pad. The visual information output from the two surfaces of the display unit 151 may be controlled by the touch pad. A display may be additionally mounted to the touch pad, and a touch screen may be arranged at the rear case 102.

The touch pad interworks with the display unit 151 of the front case 101. The touch pad may be arranged at a rear side of the display unit 151 in parallel, and may have a size equal to or smaller than that of the display unit 151.

Figure 3:
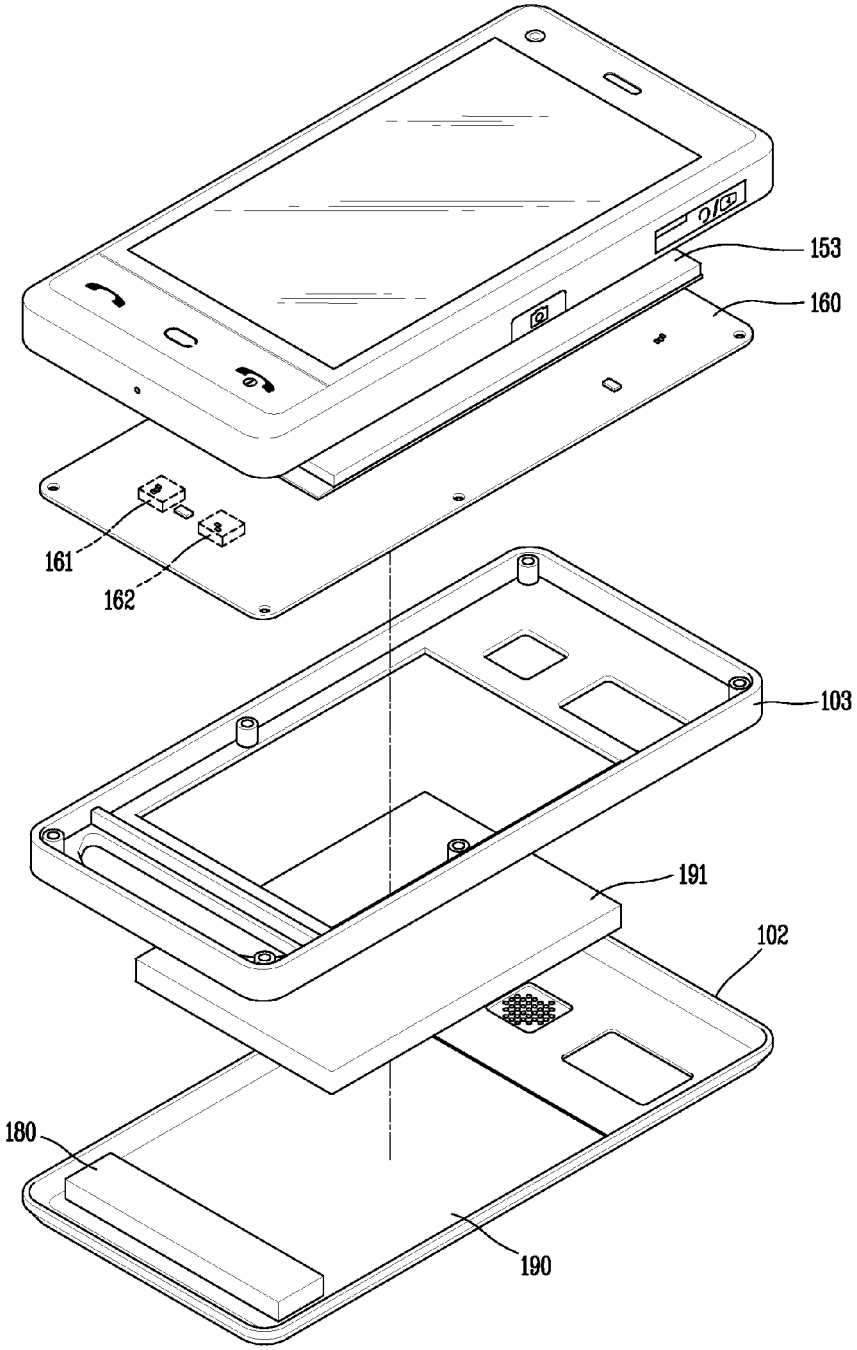
FIG. 3 is a disassembled perspective view of the mobile terminal of FIG. 1.
Figure 4:
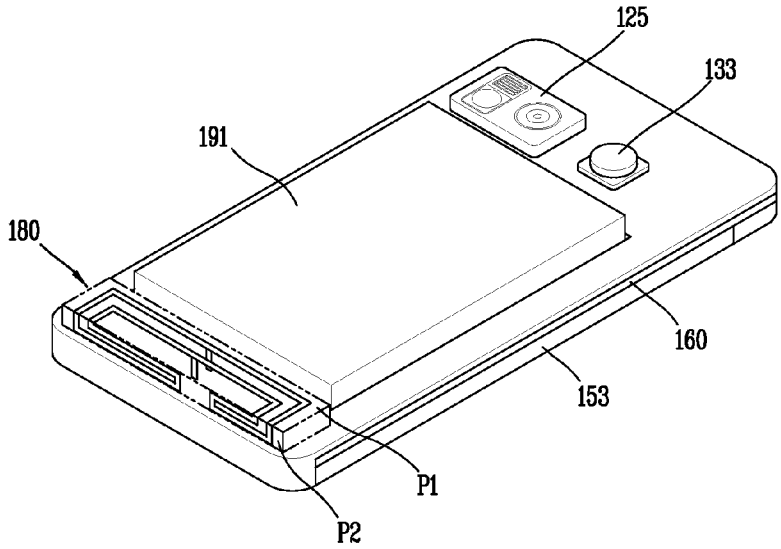
FIG. 4 is a rear perspective view of the mobile terminal of FIG. 2, which shows a rear case removed from the mobile terminal.

FIG. 3 is a disassembled perspective view of the mobile terminal of FIG. 1, and FIG. 4 is a rear perspective view of the mobile terminal of FIG. 2, which shows the rear case 102 removed from the mobile terminal. As shown in FIG. 3, the mobile terminal 100 according to one embodiment of the present invention includes an antenna device 180 which operates in a folded dipole manner. A display module 153 is mounted to one surface of the first case 101, and a printed circuit board 160 is disposed to cover the display module 153.

Each type of electronic device may be mounted on one surface of the PCB 160, and a shield member for protecting the electronic devices may be mounted to the one surface. The shield member may be electrically connected to the PCB 160 for extension of a ground of the PCB 160.

The PCB 160 may also be implemented as an example of a controller for operating each function of the mobile terminal 100. The PCB 160 may be formed in plurality, and may serve as a controller through combination thereof. In addition, the PCB 160 is electrically connected to the antenna device 180, and is configured to process a radio signal (or radio electromagnetic wave) transmitted or received by the antenna device 180. For processing of a radio signal, a plurality of transceiver circuits 161 and 162, for example, may be formed at the PCB 160.

The transceiver circuits 161 and 162 may include one or more integrated circuits, and relevant electric devices. For instance, the transceiver circuits may include a transmission integrated circuit, a reception integrated circuit, a switching circuit, an amplifier, etc. The plurality of transceiver circuits 161 and 162 may simultaneously operate by simultaneously feeding conductive members included in radiators. For instance, while one performs transmission, another can perform reception. Alternatively, both transceiver circuits can perform transmission or reception.

As an example of the power supply unit, a battery 191 is disposed inside the mobile terminal. The battery 191 is accommodated in a mounting member formed of a metallic material and having a mounting space. The mounting member may be electrically connected to the PCB 160, and may be configured to extend a ground of the PCB 160. Furthermore, the mounting member, the shield member, and a ground layer of the PCB 160 may be electrically connected to each other, thereby forming a ground of the mobile terminal.

The antenna device 180 may be implemented as part thereof and be thermally melted or compressed to a case of the terminal body, a battery cover, or a carrier. Alternatively, part of the antenna device 180 may be printed on the case of the terminal body, the battery cover or the carrier. Still alternatively, part of the antenna device 180 may be attached onto the case of the terminal body, the battery cover or the carrier in the form of a film. Here, the compression indicates that a conductive metallic plate to serve as a radiator is mounted to a plastic carrier of a predetermined shape in a pressed manner.

Next, FIG. 4 shows conductors are printed on a carrier. Further, the antenna device 180 according to one embodiment of the present invention may be formed in plurality near an upper end or a lower end of the terminal body. Alternatively, the antenna device 180 may be formed near a side end of the terminal body.

The antenna device 180 is an antenna configured to transmit and receive radio signals corresponding to at least one of a personal communication system (PCS), an advanced wireless service (AWS), a digital communications network (DCN) and a long term evolution (LTE). Alternatively, the antenna device 180 may be one of a broadcast signal receiving antenna which operates in an FM radio frequency band or a Bluetooth band or a WIFI band, a Bluetooth antenna, a satellite signal receiving antenna, and a wireless Internet data receiving antenna. The antenna device 180 according to one embodiment of the present invention may be a smart MIMO (multi input multi out) antenna system, which may be considered as 'hybrid antenna' since the antenna systems operate in different bands and have different forms.

Figure 5A:
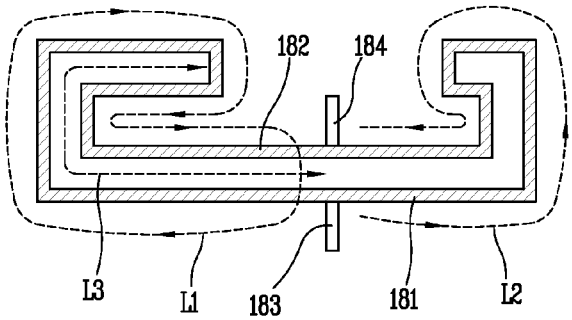
FIGS. 5A and 5B are conceptual views showing embodiments of an antenna device according to the present invention.
Figure 5B:
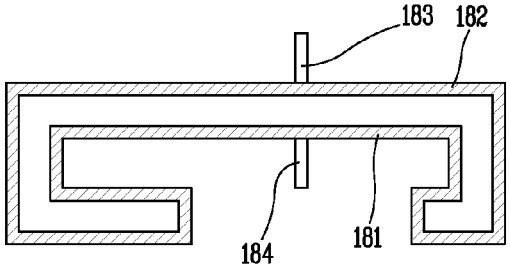

Next, FIGS. 5A and 5B are conceptual views showing embodiments of an antenna device according to the present invention. As shown, the antenna device 180 includes a plurality of conductive members, more specifically, a first conductive member 181 and a second conductive member 182 which are disposed in parallel. A feed connection portion 183 or a ground connection portion 184 is connected to one of the two conductive members, and the ground connection portion 184 or the feed connection portion 183 is connected to another of the two conductive members. The members are connected to each other at one point, thereby forming a loop.

Under the configuration that the feed connection portion 183 and the ground connection portion 184 are coupled to the conductive members facing each other, the antenna device 180 serves as a loop antenna having different resonant lengths according to rotation directions. Here, the resonant length indicates a physical length of an antenna for transmitting and receiving a radio signal at a specific frequency band.

Referring to FIG. 5A, the antenna device 180 according to one embodiment of the present invention is formed to have a resonant length (L1) in a clockwise direction from the feed connection portion 183 to the first ground connection portion 184 via the first conductive member 181 and the second conductive member 182, and is formed to have a resonant length (L2) in a counterclockwise direction from the feed connection portion 183 to the first ground connection portion 184 via the first conductive member 181 and the second conductive member 182. In addition, a slot antenna having a third resonant length may be defined by a gap between the first conductive member 181 and the second conductive member 182, and may have a length (L3) from one connection point between the first conductive member 181 and the second conductive member 182 to the first ground connection portion 184.

A first resonant length, a second resonant length and a third resonant length correspond to a half wavelength ($\lambda/2$) of a central frequency. Accordingly, the radiation resistance is enhanced, and a 'Q' value of an antenna is lowered. As a result, the antenna device 180 according to one embodiment of the present invention has a higher radiation efficiency and a wider band than a PIFA antenna or an antenna having a monopole structure.

Generally, a radio function of an antenna device is influenced by an electric device. In addition, in the related art, an antenna device is installed in a free space inside a mobile terminal at a position spaced from a display panel by a predetermined distance. However, the antenna device 180 according to one embodiment of the present invention is disposed to cover part of the display module 153, as shown in FIG. 4, due to an enhanced antenna characteristic.

Under this configuration, no free space for mounting the antenna device 180 is required between the antenna device 180 and the display module 153, or between the antenna and the terminal case. This advantage miniaturizes the entire size of the mobile terminal. The antenna device 180 according to one embodiment of the present invention may also be disposed to cover part of the display module 153 and be disposed near one end of the terminal case.

Referring to FIG. 5B, the antenna device 180 according to another embodiment of the present invention may be designed to transmit and receive radio signals at different frequency bands by changing the positions of the feed connection portion 183 and the ground connection portion 184. Referring to FIGS. 4 and 5A, the first conductive member 181 and the second conductive member 182 are spaced from each other, and are disposed in parallel. In addition, the first conductive member 181 and the second conductive member 182 are bent from extended points, and extend from the bent positions in parallel toward one direction.

As shown in FIG. 4, the first conductive member 181 and the second conductive member 182 extend in parallel from a first plane (P1), and are bent from one or more points. In addition, the first conductive member 181 and the second conductive member 182 extend from the bent positions in parallel toward one direction. Here, the first conductive member 181 and the second conductive member 182 which extend from the bent positions may be disposed on a second position (P2) crossing the first plane (P1). The first plane (P1) may be one surface of upper and lower surfaces of the terminal body, and the second plane (P2) may be one surface of side surfaces of the terminal body.

The first conductive member 181 or the second conductive member 182 may have a meander structure in which the first conductive member 181 or the second conductive member 182 is implemented in the form of a curved conductor so as to have a predetermined length corresponding to a specific frequency.

One of the first conductive member 181 and the second conductive member 182 may also be ground-connected to a PCB 160 having a ground by the ground connection portion 184. The ground connection portion 184 is ground-connected to one of the first conductive member 181 and the second conductive member 182 to electrically short the one, thereby performing impedance matching with respect to a resonance frequency.

The ground connection portion 184 is configured to ground the first conductive member 181 or the second conductive member 182, by electrically connecting an electric ground to one end of the first conductive member 181 or the second conductive member 182. Here, the electric ground may be a ground of the PCB 160.

The ground connection portion 184 may be provided with two or more paths having different lengths, and may be provided with switches corresponding to the respective paths. Here, each path connects an electric ground to one of radiators (e.g., first member) in a different length, through a corresponding switch provided thereat. The path indicates an electric passage which connects an electric ground to a radiator, and may include a ground plate, a ground clip and a ground line. The path may have a different length by having a ground line of a different length.

The PCB 160 is feed-connected to one of the first conductive member 181 and the second conductive member 182 by the feed connection portion 183. The feed connection portion 183 is configured to feed one of the first conductive member 181 and the second conductive member 182, in an electric connection manner (or electro-magnetic (EM) feeding manner). The feed connection portion 183 electrically connects a feeding device to one of the first conductive member 181 and the second conductive member 182.

For this connection, the feed connection portion 183 may include a ground plate, a ground clip and a ground line. The ground plate, the ground clip and the ground line are connected to each other, and transmits a current (or voltage) fed through a feeding device to a conductor of a radiator. Here, the ground line may include a microstrip printed on the PCB.

The first conductive member 181 or the second conductive member 182 is partially or entirely formed as a conductor, and operates as a radiator. The first conductive member 181 or the second conductive member 182 may be formed in various manners according to a resonance characteristic or a frequency characteristic. Further, a current is fed to the conductor through the feed connection portion 183, and the fed current is shorted through the ground connection portion 184. Thus, the antenna device 180 includes independent tuning and has an optimized design in an easy manner.

Figure 6A:
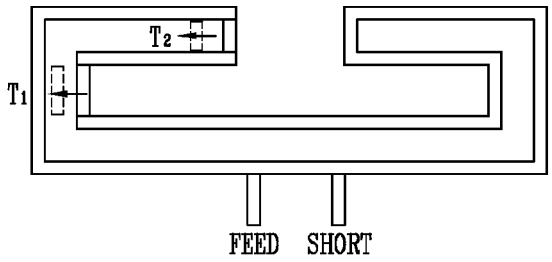
FIG. 6A is a conceptual view of an antenna device according to a comparative example of the present invention.
Figure 6B:
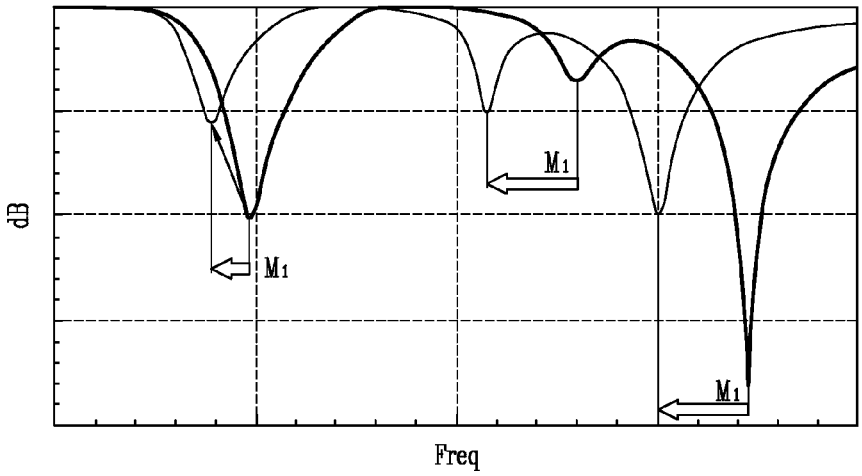
FIGS. 6B and 6C are graphs showing shifts of central frequencies due to tuning.
Figure 6C:
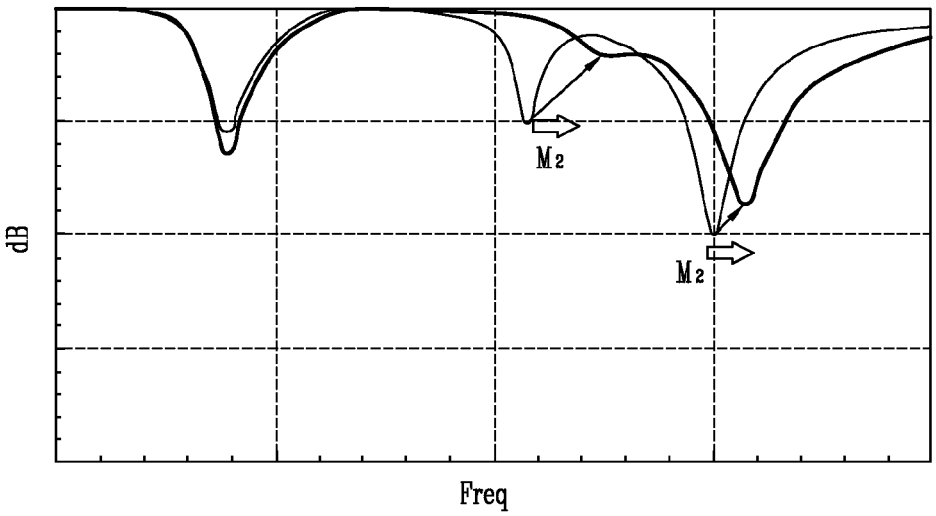
Figure 7A:
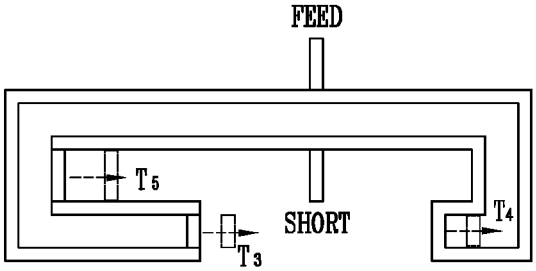
FIG. 7A is a conceptual view of an antenna device according to one embodiment of the present invention.
Figure 7B:
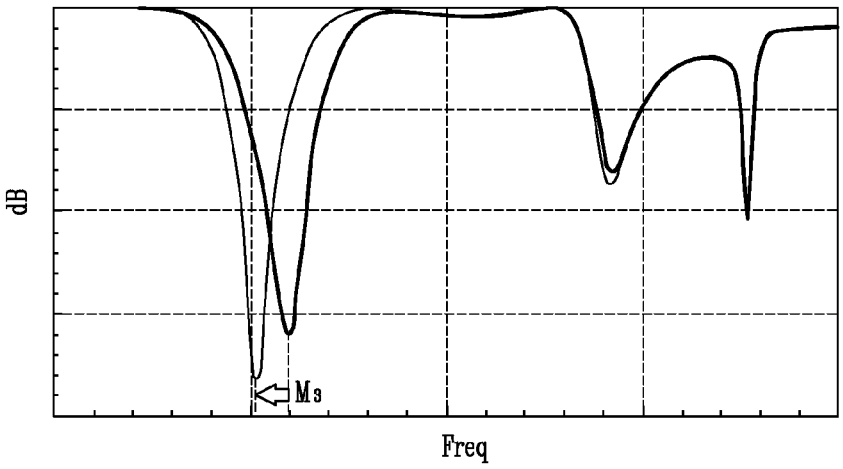
FIGS. 7B to 7D are graphs showing shifts of central frequencies due to tuning.
Figure 7C:
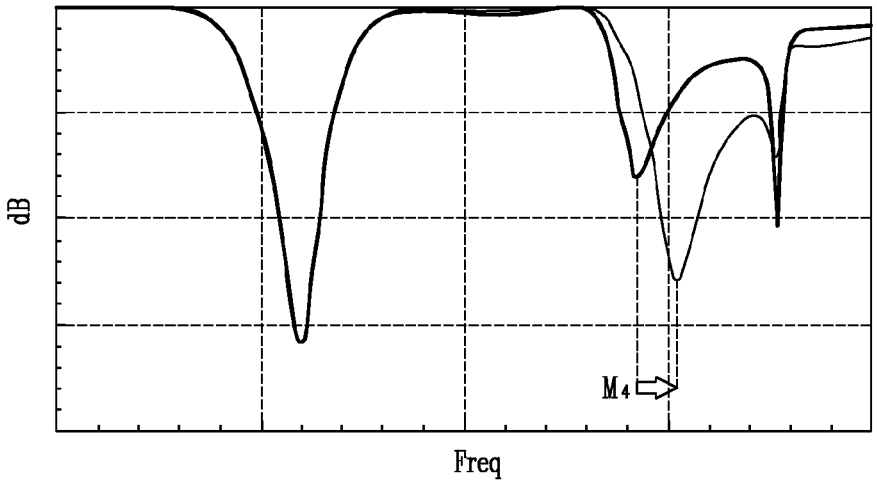
Figure 7D:
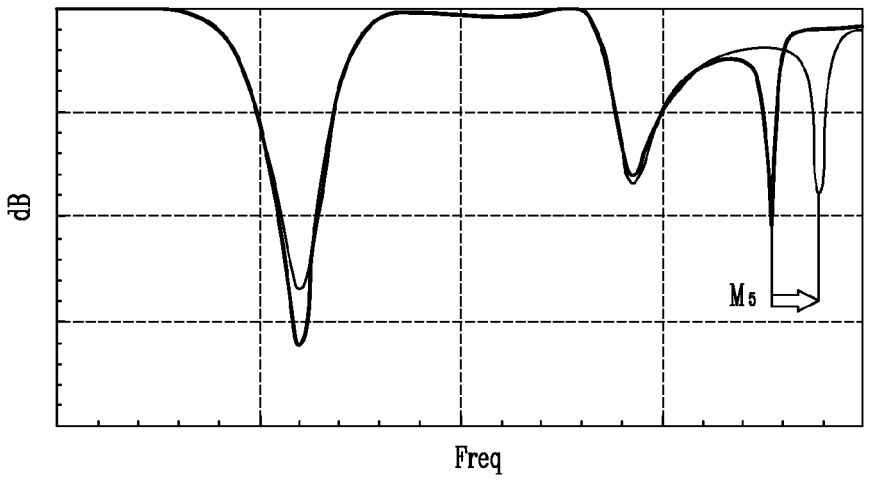

Next, FIG. 6A is a conceptual view of an antenna device 180 according to a comparative example of the present invention, FIGS. 6B and 6C are graphs showing shifts of central frequencies due to tuning, FIG. 7A is a conceptual view of the antenna device 180 according to one embodiment of the present invention, and FIGS. 7B to 7D are graphs showing shifts of central frequencies due to tuning.

In particular, FIG. 6A is a view showing that a resonant length is adjusted by changing a connection point between the first conductive member 181 and the second conductive member 182. Referring to FIGS. 6A and 6B, once the resonant length is adjusted (T1), a central frequency is shifted (M1) at all frequency bands. Referring to FIGS. 6A and 6C, once the resonant length is adjusted (T2), a central frequency is shifted (M2) at all frequency bands.

For instance, for a multi-band antenna configured to transmit and receive radio signals in all frequency bands of GSM (global system for mobile communication) 850, PCS and WCDMA (wideband CDMA) (2.4 GHz), the multi-band antenna may not function at a specific band. In this instance, once a resonant length of the multi-band antenna is adjusted for tuning, an antenna function may be lowered at a specific band.

Also, for a folded dipole antenna, a central frequency is shifted in all frequency bands due to control of a resonant length at a specific part. This causes a difficulty in a frequency design. In order to solve this problem, in the present invention, the feed connection portion 183 and the ground connection portion 184 are coupled to the conductive members 181 and 182 facing each other. In this instance, resonant lengths of other central frequencies rather than a corresponding central frequency do not change at the time of turning. This facilitates an antenna design.

Referring to FIGS. 7A to 7D, when the respective resonant lengths are adjusted (T3, T4 and T5), central frequencies at other frequency bands are not shifted, but only a central frequency at a corresponding frequency band is shifted (M3, M4 and M5).

Figure 8A:
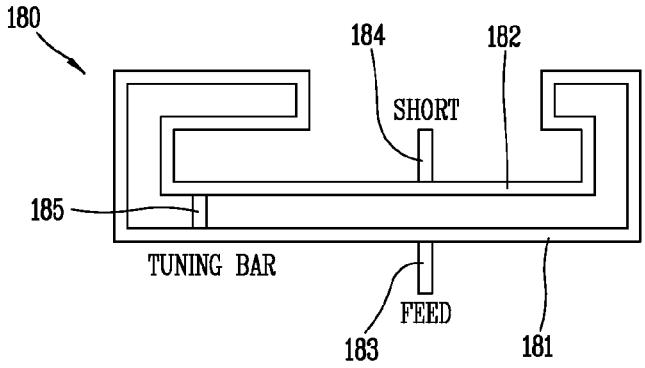
FIGS. 8A to 8E are conceptual views of antenna devices according to modified examples of the present invention.

Next, FIGS. 8A to 8E are conceptual views of antenna devices 180, 280 and 380 according to modified examples of the present invention. Referring to FIG. 8A, a feed connection portion 183 is connected to a first conductive member 181, and a ground connection portion 184 is connected to a second conductive member 182. The first conductive member 181 and the second conductive member 182 are spaced from each other, and are disposed in parallel. Also, the first conductive member 181 and the second conductive member 182 are bent from extended points, and extend from the bent positions in parallel toward one direction.

A tuning bar 185 configured to connect the first conductive member 181 and the second conductive member 182 to each other is also formed at one point on a path implemented in a clockwise direction from the feed connection portion 183 to the ground connection portion 184 via the first conductive member 181. The tuning bar 185 changes a maximum impedance value of a loop by changing the impedance of the first conductive member 181 and the impedance of the second conductive member 182 and the impedances implemented near connection points between the first and second conductive members.

Figure 8B:
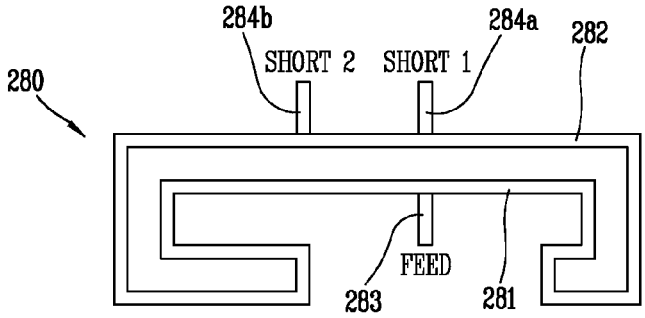

Referring to FIG. 8B, a feed connection portion 283 is connected to a first conductive member 281, and a first ground connection portion 284*a* is connected to a second conductive member 282. FIG. 8B is differentiated from FIG. 8A in that the second conductive member 282 is formed to encompass the first conductive member 281, and a second ground connection portion 284*b* is added to the second conductive member 282.

Under this configuration, a second resonant length is formed. Here, the second resonant length means a path formed in a counterclockwise direction from the feed connection portion 283 to the first ground connection portion 284*a* via the first conductive member 281. In addition, the second ground connection portion 284*b* may be formed at a point on a path implemented in a clockwise direction from the feed connection portion 283 to the first ground connection portion 284*a* via the first conductive member 281, thereby controlling the first resonant length.

A slot antenna having a third resonant length may also be defined by a gap between the first conductive member 281 and the second conductive member 283, and has a length from one connection point between the first and second conducive members to the first ground connection portion 284*a*. In this instance, the third resonant length may be variable due to the second ground connection portion 284*b*.

Figure 8C:
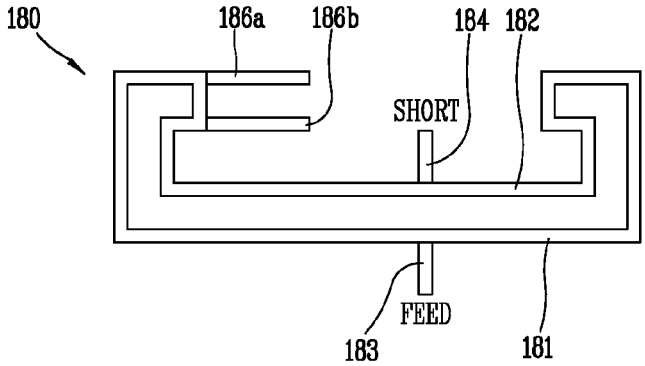

Referring to FIG. 8C, a feed connection portion 183 is connected to a first conductive member 181, and a ground connection portion 184 is connected to a second conductive member 182. Also, sub-conductive members 186*a* and 186*b* extend from a path formed in a clockwise direction from the feed connection portion 183 to the ground connection portion 184 via the first conductive member 181 and the second conductive member 182. Due to the length of the sub-conductive members 186*a* and 186*b*, the entire length of the path is extended and the first resonant length can be adjusted. Here, an area of an antenna radiator is increased by an adjusted length, resulting in enhancing a bandwidth. The sub-conductive members 186*a* and 186*b* may be implemented to have a meander structure or a planner patch form.

Figure 8D:
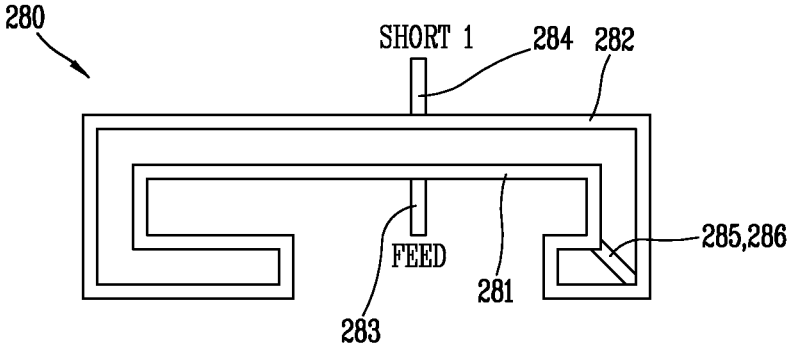

Referring to FIG. 8D, a feed connection portion 283 is connected to a first conductive member 281, and a ground connection portion 284 is connected to a second conductive member 282. A sub-conductive member 286 or a tuning bar 285 may be formed on a path implemented in a counterclockwise direction from the feed connection portion 283 to the ground connection portion 284 via the first conductive member 281 and the second conductive member 282. The sub-conductive member 286 or the tuning bar 285 changes an antenna characteristic by controlling a second resonant length.

Figure 8E:
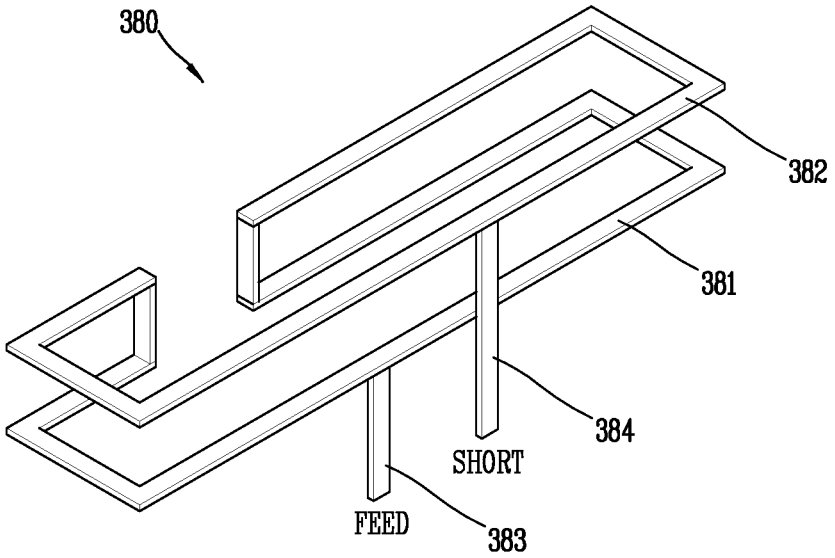

Referring to FIG. 8E, a first conductive member 383 and a second conductive member 382 are formed on different planes spaced from each other, and are connected to each other at one point. A feed connection portion 383 is connected to the first conductive member 383, and a ground connection portion 384 is connected to the second conductive member 382. In the same manner as in the aforementioned embodiments, connection points between the conductive members are variable to enable tuning at a desired frequency band. Furthermore, in the antenna device of FIG. 8E, the first conductive member 383 and the second conductive member 382 are spaced from each other in a Z-direction in space, not in X and Y directions on the same plane. In this instance, an area occupied by the conductive members 383 and 382 on one plane is deceased. As a result, the entire size of the antenna can be miniaturized.

The first conductive member 383 and the second conductive member 382 may also be formed in a carrier to have a double structure, or may be respectively formed on an upper and lower surfaces of the carrier. Alternatively, the first conductive member 383 and the second conductive member 382 may be formed at different cases, and may be connected to each other.

Thus, the present invention may have the following advantages. First, the feed connection portion and the ground connection portion are respectively coupled to conductive members facing each other. This implements a loop antenna having different resonant lengths according to rotation directions. As a result, the antenna device can be tuned in an independent manner, and have an optimum design.

Secondly, a first resonant length, a second resonant length and a third resonant length correspond to a half wavelength ($\lambda/2$) of a central frequency. Accordingly, the radiation resistance is enhanced, and a 'Q' value of an antenna is lowered. As a result, no free space for mounting the antenna device is required between the antenna device and a display panel, or between an antenna and a terminal case. This miniaturizes the entire size of the mobile terminal.

The foregoing embodiments and advantages are merely exemplary and are not to be construed as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A mobile terminal, comprising:

a terminal body having a ground;

a first conductive member and a second conductive member mounted in the terminal body, and spaced from each other and configured to transmit and receive a radio signal, wherein the first conductive member and the second conductive member are connected to each other to form a loop;

a feed connection portion connected to the first conductive member and configured to feed-connect the first conductive member;

a first ground connection portion connected to the second conductive member and configured to ground-connect the second conductive member to a printed circuit board; and a second ground connection portion configured to ground-connect the second conductive member to the printed circuit board, the second ground connection portion is disposed to be spaced apart from the first ground connection portion, wherein a first path implemented in a first rotation direction from the feed connection portion to the first ground connection portion via the first and second conductive members includes a first resonant length for transmitting and receiving the radio signal at a first frequency band, wherein a second path implemented in a second rotation direction from the feed connection portion to the second ground connection portion via the first and second conductive members includes a second resonant length for transmitting and receiving the radio signal at a second frequency band, wherein at least one slot antenna is defined by a gap between the first and second conductive members, and wherein the slot is configured to resonate at a third frequency band.

2. The mobile terminal of claim 1, wherein the first and second conductive members are disposed in parallel on a first plane, are bent from one or more points, and extend from the one or more points in parallel toward one direction to reduce the resonant length.

3. The mobile terminal of claim 2, wherein the first and second conductive members extend from the bent positions are disposed on a second plane crossing the first plane.

4. The mobile terminal of claim 3, wherein the first plane is one surface of upper and lower surfaces of the terminal body, and the second plane is one side surface of the terminal body.

5. The mobile terminal of claim 1, further comprising:

a carrier mounted to the terminal body at one end of the terminal body, said first and second conductive members being disposed on one surface of the carrier.

6. The mobile terminal of claim 5, further comprising:

a display panel configured to display visual information, wherein the printed circuit board has the display panel on one surface thereof and is configured to process the radio signal, and wherein the carrier is disposed on another surface of the printed circuit board.

* * * * *